US006792721B1

(12) United States Patent
Montanari

(10) Patent No.: US 6,792,721 B1
(45) Date of Patent: Sep. 21, 2004

(54) SHOWER APPARATUS

(75) Inventor: Filippo Montanari, Crespellano (IT)

(73) Assignee: Calibe S.r.l., Crespellano (IT)

( * ) Notice: Subject to any disclaimer, the term of this patent is extended or adjusted under 35 U.S.C. 154(b) by 0 days.

(21) Appl. No.: 09/869,841

(22) PCT Filed: Nov. 10, 2000

(86) PCT No.: PCT/EP00/11159

§ 371 (c)(1),
(2), (4) Date: Jul. 6, 2001

(87) PCT Pub. No.: WO01/35806

PCT Pub. Date: May 25, 2001

(30) Foreign Application Priority Data

Nov. 18, 1999 (IT) ..... TV99A0127

(51) Int. Cl.[7] ..... A47K 3/16

(52) U.S. Cl. ..... 52/35; 52/127.6; 52/34; 4/612; 4/613

(58) Field of Search ..... 52/34, 35, 217, 52/204.71, 204.72; 4/612, 613, 614; 49/410, 411

(56) References Cited

U.S. PATENT DOCUMENTS 5,852,837 A * 12/1998 Husting ..... 4/607
6,023,889 A * 2/2000 Husting et al. ..... 52/35

FOREIGN PATENT DOCUMENTS

DE A- 36 00 945 10/1986
DE 3800882 A1 * 1/1988 ..... E05D/15/06
WO A- 95 19131 7/1995

* cited by examiner

*Primary Examiner*—Carl D. Friedman
*Assistant Examiner*—Nahid Amiri
(74) *Attorney, Agent, or Firm*—Guido Modiano; Albert Josif; Daniel O'Byrne

(57) ABSTRACT

A shower apparatus, comprising an enclosure or a door and a shower tray, the enclosure or door and the shower tray being mutually disconnected and the enclosure or door having means for adjustable connection to walls that form a cubicle that accommodates the apparatus.

37 Claims, 6 Drawing Sheets

SHOWER APPARATUS

BACKGROUND OF THE INVENTION

The present invention relates to a shower apparatus.

Shower apparatuses are currently in use being usually constituted by an enclosure made of a rigid material, for example, glass, Plexiglas or other translucent or transparent material, which is placed for example in a corner of a suitable room or in a recess or along a wall.

The enclosure is therefore for example fixed on two sides to the walls of the room and rests in a downward region on a shower tray.

Resting on the shower tray occurs according to various solutions, since the lower end of the enclosure can rest on the entire upper rim of the shower tray or only on a part thereof, for example by using, on the region adjacent to the door, spacer pins which are arranged between the lower end of the enclosure and the upper rim of the shower tray.

The enclosure is usually constituted by a frame whereto a door is slidingly fixed or hinged.

The door can therefore be for example coupled in an upward region to the enclosure frame so that it can slide and can be guided in a downward region on a seat which is rigidly coupled above the upper rim of the shower tray.

As an alternative, the door can slide by resting, on a suitable gasket, on the upper rim of the shower tray.

The main drawback of these conventional shower apparatuses is that unsightly and scarcely hygienic deposits of scale and other matter, accumulations of dirt, mold and bacteria due to stagnation of water after use often form in the points of contact between the enclosure and the shower tray.

These stagnations are often due to difficulty in being able to dry and clean interstices that are present proximate to these resting points, such interstices being also awkward to access because they are arranged at floor level.

Another drawback of conventional shower apparatuses is that they can require, in the resting regions, the presence of gaskets and/or silicone seals which, in addition to be prone to deterioration and unsightly, worsen the noted drawbacks due to water stagnation and entail an additional intervention during installation.

Another drawback consists in that water can escape due to the contact, which acts as a path for connection to the outside of the shower cubicle, between the enclosure, which is internally wet, and the rim of the shower tray, which is adjacent to the flooring that lies outside the shower cubicle.

Another drawback of conventional shower apparatuses is that they have a complicated adjustment, by means of shims, of the position of the enclosure with respect to the walls, this adjustment being necessary because the walls are never perfectly vertical and perpendicular to the floor.

SUMMARY OF THE INVENTION

The aim of the present invention is to solve the above-noted problems, eliminating the drawbacks of the cited prior art, by providing a shower apparatus which is easy and straightforward to install and clean, avoiding the presence of water stagnation regions which cause, for example, the formation of scale deposits.

Within this aim, an object of the invention is to provide a shower apparatus which prevents the escape from the shower cubicle even of minimal amounts of water, thus avoiding the need to subsequently dry up the escaped water and, even more importantly, avoiding the possibility of accidents caused by the fact that someone slips on said water.

Another object of the invention is to provide a shower apparatus which achieves the intended aim and objects without requiring the use of unsightly silicone seals and/or gaskets, which would also help to worsen the above-noted problems.

Another object of the invention is to provide a shower apparatus which is structurally simple and has low manufacturing costs.

This aim and these and other objects which will become better apparent hereinafter are achieved by a shower apparatus, comprising an enclosure or a door and a shower tray, characterized in that said enclosure or door and said shower tray are mutually disconnected, said enclosure or door having means for adjustable connection to the walls that form the cubicle for accommodating the apparatus.

BRIEF DESCRIPTION OF THE DRAWINGS.

Further characteristics and advantages of the present invention will become better apparent from the following detailed description of a particular embodiment thereof, illustrated only by way of non-limitative example in the accompanying drawings, wherein.

DESCRIPTION OF THE PREFERRED EMBODIMENTS

Figure 1:
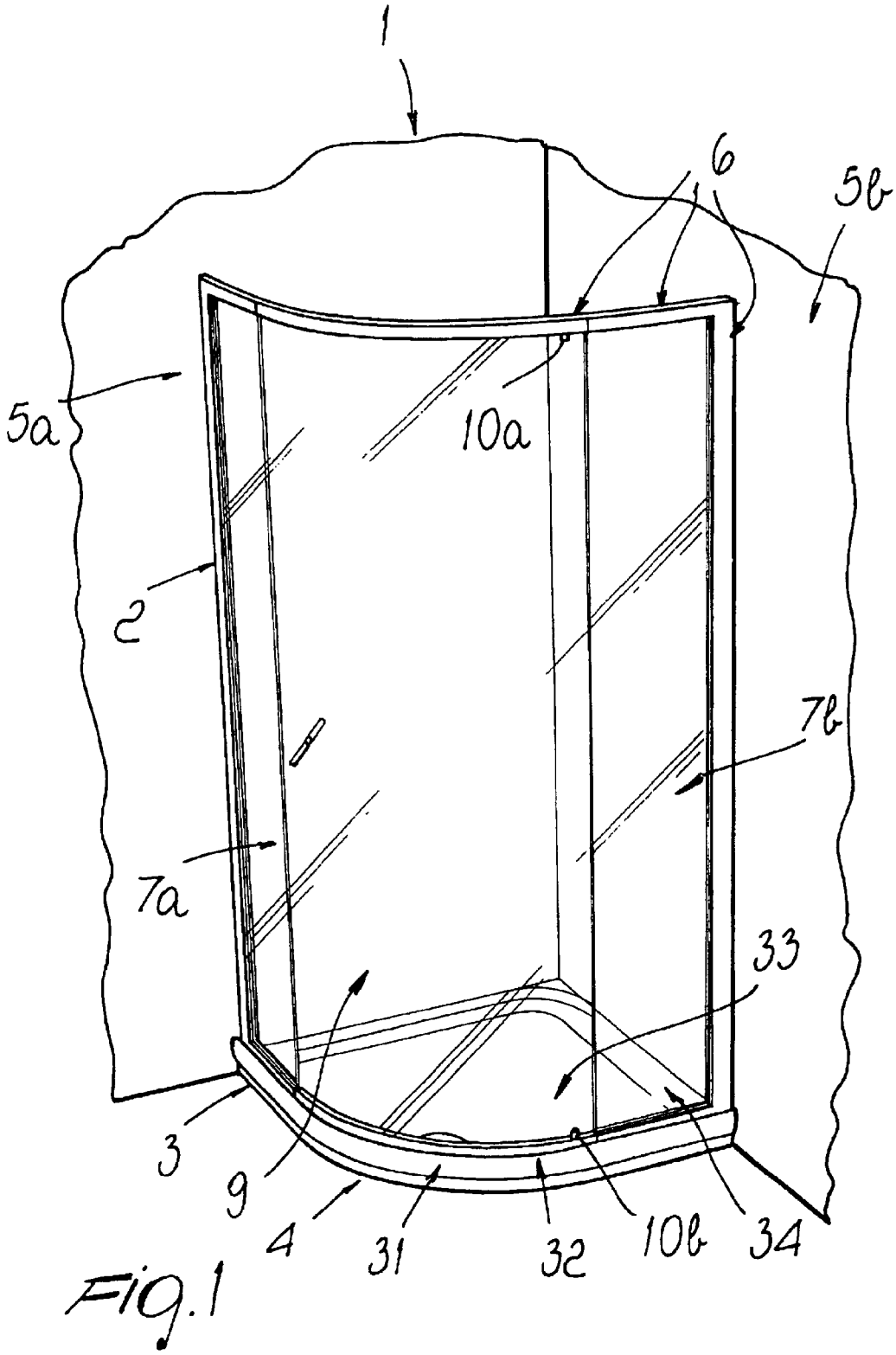
FIG. 1 is a perspective view of the shower apparatus according to the present invention.
Figure 2:
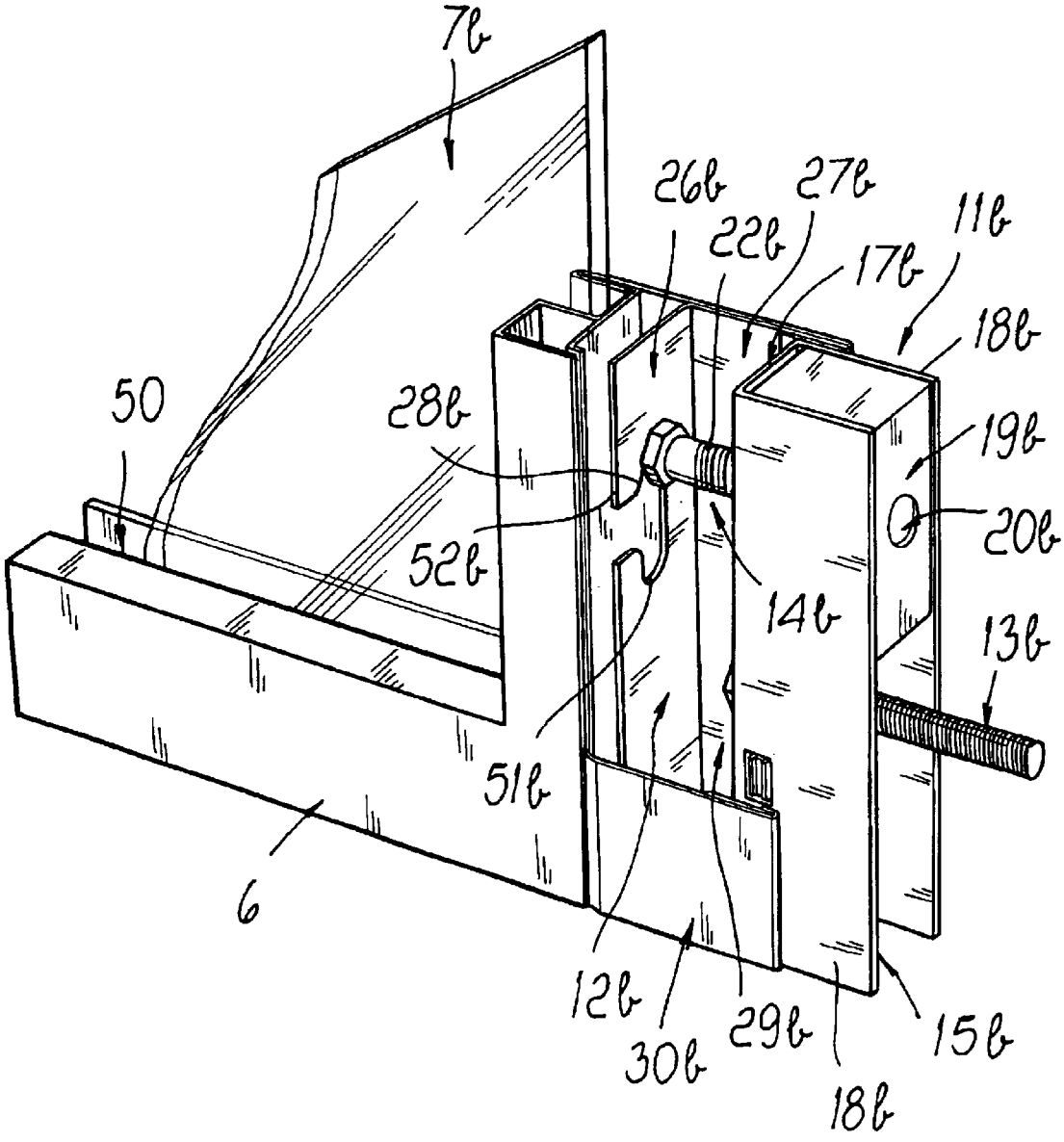
FIG. 2 is a perspective view of a detail of the wall anchoring and adjustment system.
Figure 3:
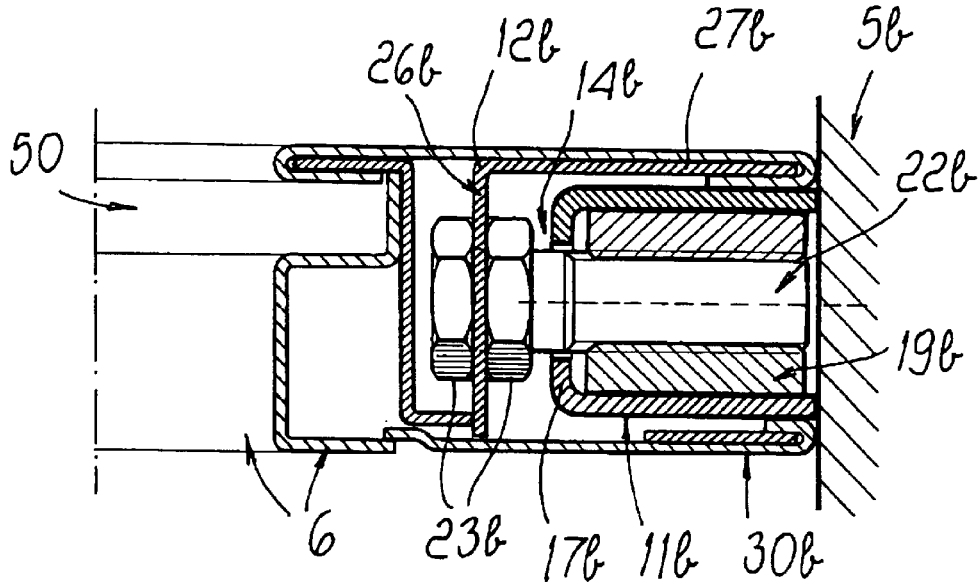
FIG. 3 is a sectional plan view of a detail of the wall anchoring and adjustment system at minimum extension.
Figure 4:
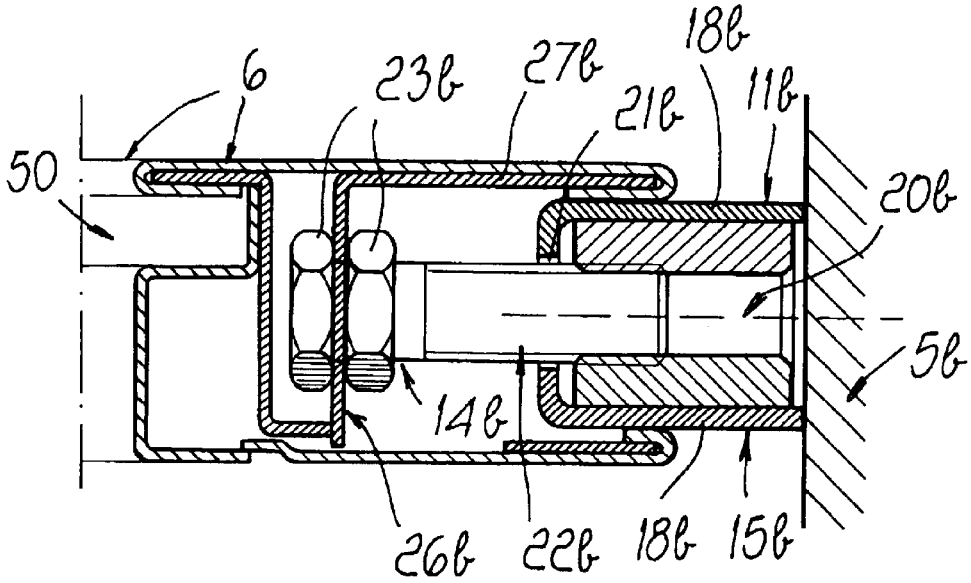
FIG. 4 is a sectional plan view of a detail of the wall anchoring and adjustment system at maximum extension.
Figure 5:
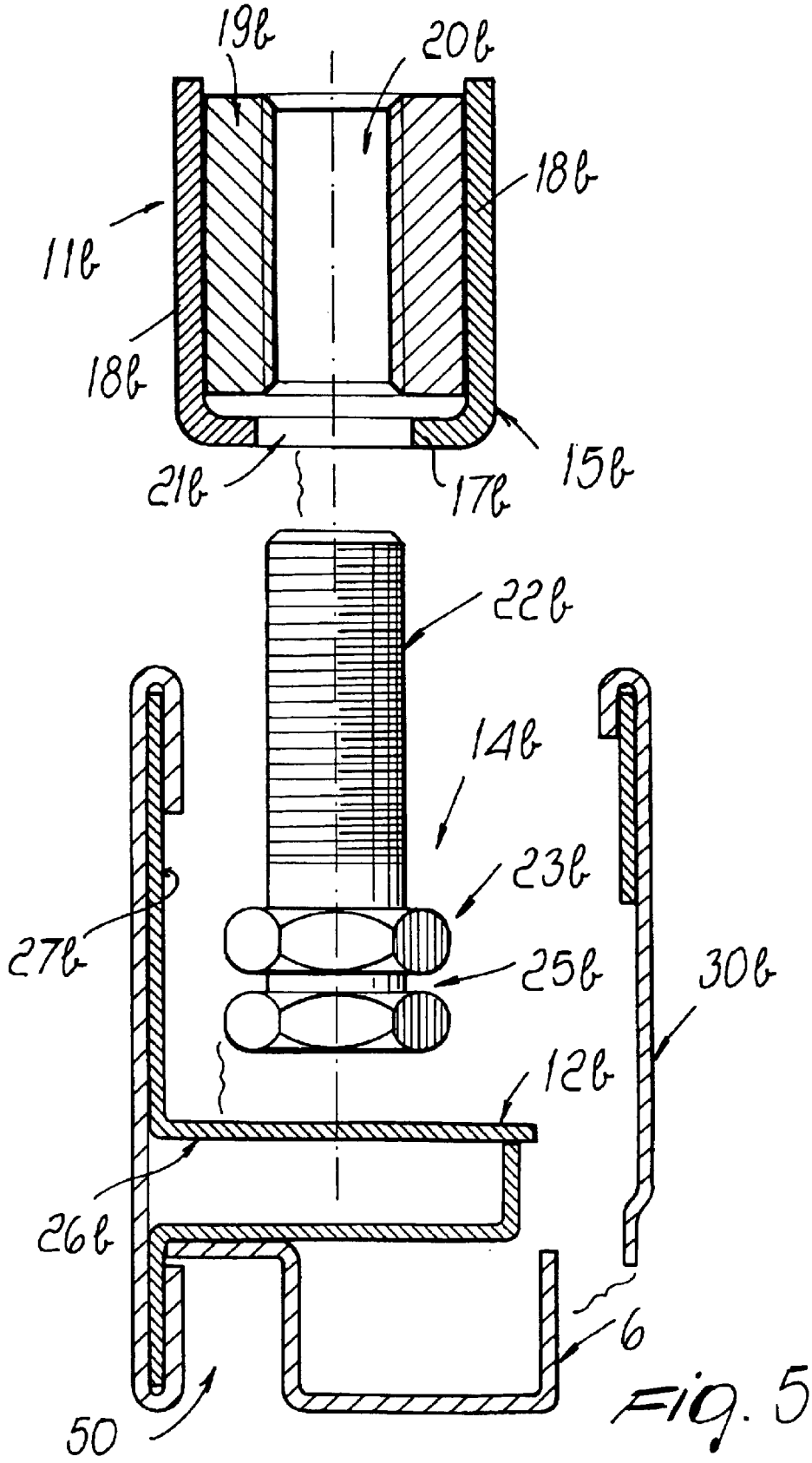
FIG. 5 is a sectional exploded plan view of the elements that compose the anchoring and adjustment system.
Figure 6:
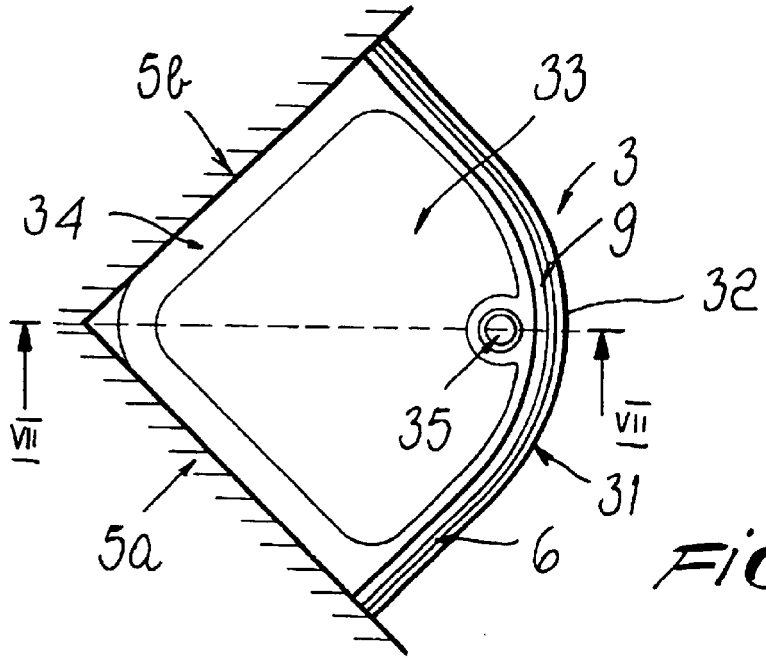
FIG. 6 is a plan view of the invention.
Figure 7:
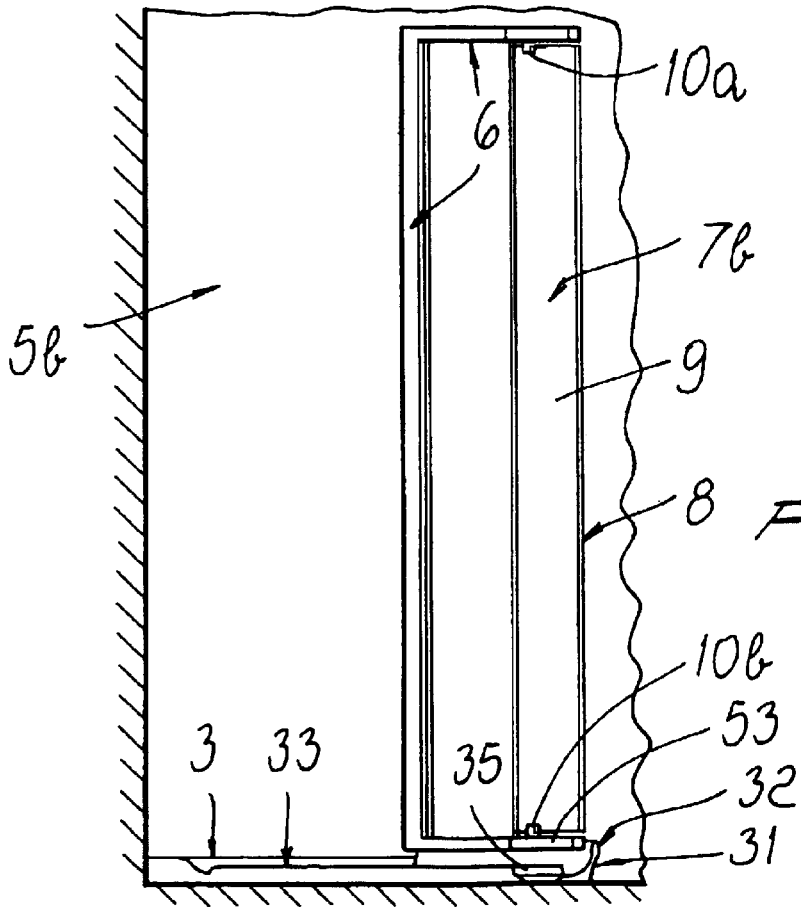
FIG. 7 is a side view of the invention.
Figure 8:
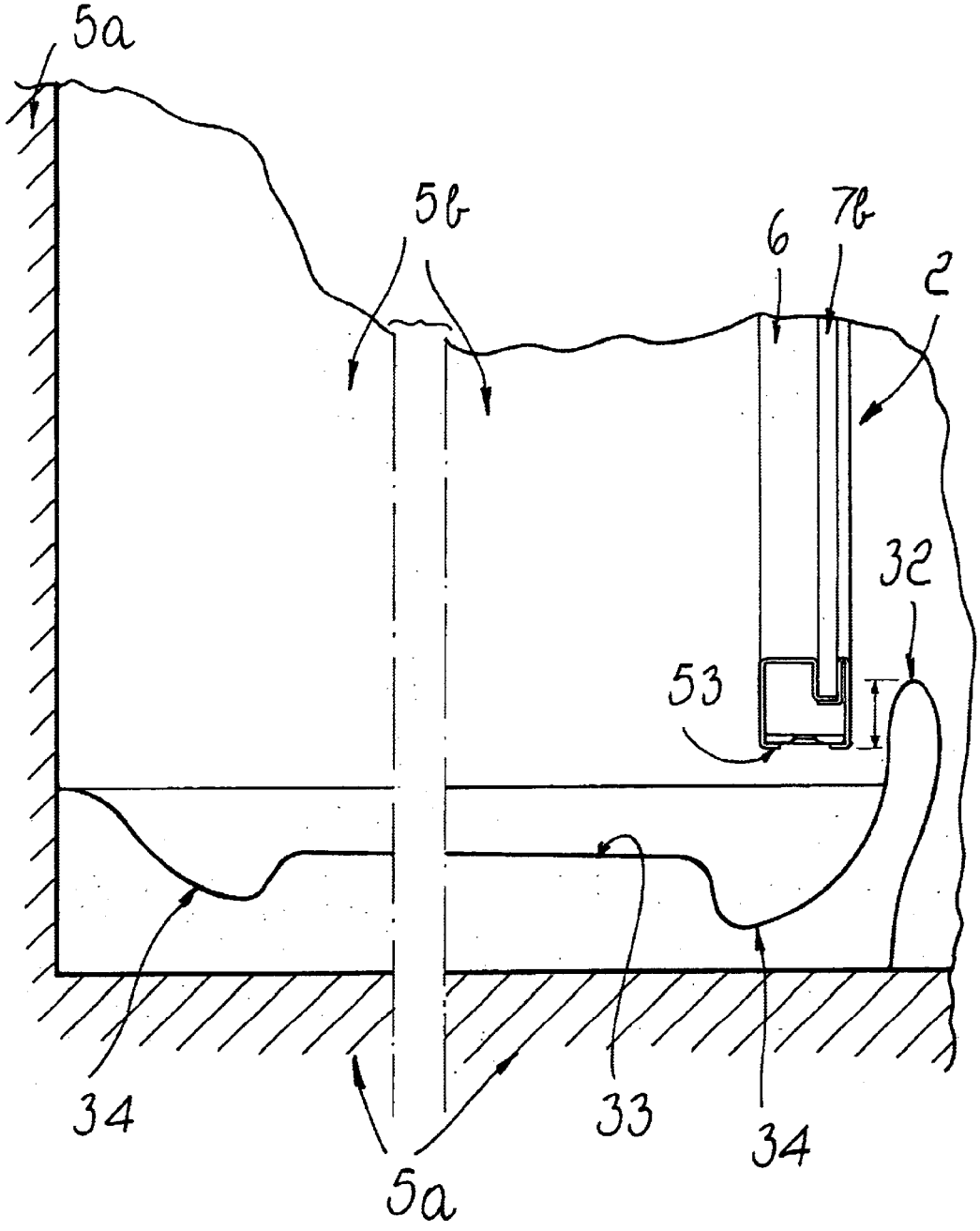
FIG. 8 is a sectional side view of the shower tray, taken along a plane which is parallel to a wall.

With reference to the figures, the reference numeral 1 designates a shower apparatus which comprises an enclosure or door 2 and a shower tray 3.

The enclosure 2 is arranged in a shower cubicle, designated by the reference numeral 4, which in this embodiment is delimited by two vertical walls 5*a* and 5*b* being advantageously perpendicular one another so as to form a shower corner which accommodates the apparatus 1.

The enclosure 2, seen in plan view, advantageously has a side which is shaped like a circular arc with the convexity facing outward; the enclosure is constituted by a frame, designated by the reference numeral 6, having a peripheral seat 50 inside which two glazing panels 7*a* and 7*b* are preferably arranged. The panels are advantageously rectangular and flat and are each arranged adjacent to the walls 5*a* and 5*b*.

An opening, designated by the reference numeral 8, is provided between the glazing panels 7*a* and 7*b*, advantageously in a central position, and is adapted to accommodate a door 9 which is preferably shaped like a circular arc and is coupled to the frame 6, preferably by means of two vertical hinges 10*a* and 10*b* which protrude from the same along the same axis.

The apparatus 1 has appropriate means for the adjustable connection of the enclosure 2 to the walls 5*a* and 5*b*.

Since the connection means are identical for each wall, only the means for connection to the wall 5*b* are described for the sake of simplicity.

The connection means are constituted by a post, designated by the reference numeral 11*b*, which rests vertically on the wall 5*b*; by a first profiled element 12*b*, which is L-shaped-and rigidly coupled to the frame 6; by first connection screws 13*b* for the removable connection of the post 11*b* to the wall 5*b*; and by second adjustment screws 14*b* for the adjustable connection of the mutual position between frame 6 and post 11*b*.

The post 11*b* is constituted by a second profiled element, designated by the reference numeral 15*b*, having advantageously a C-shaped transverse cross-section which has a base, designated by the reference numeral 17*b*, and two wings 18*b* which advantageously have the same dimensions and protrude, in the same direction, toward the wall 5*b*.

The base 17*b* of the second profiled element 15*b* is advantageously arranged parallel to the wall 5*b* and has first holes, not shown, which are adapted for detachable connection, by means of the first connecting screws 13*b*, to the wall 5*b*, in which adapted wall anchors are associated beforehand.

Locking elements are associated with the post 11*b* and are constituted by nuts 19*b* which are accommodated within the wings 18*b* and are provided with second threaded holes 20*b* which have a horizontal axis and are arranged at similar third holes 21*b* which are formed in the base 17*b* of the second profiled element, in a staggered position with respect to the first holes.

The second adjustment screw 14*b* has a threaded stem 22*b* which can be inserted, through said third and second holes 21*b* and 20*b*, in the locking element or nut 19*b*, and a head, designated by the reference numeral 23*b*, on the lateral surface 24*b* whereof there is an annular milling 25*b*.

The first profiled element 12*b*, which has an advantageously L-shaped cross-section, is arranged so as to have a first wing 26*b* being approximately parallel to the base 17*b* of the second profiled element and a second wing 27*b* being advantageously perpendicular to the first wing 26*b*.

At least one of the two wings 26*b* and 27*b* has surfaces for coupling, advantageously by welding or gluing, to the frame 6.

Two or more vertical slots, designated by the reference numeral 28*b*, are formed in the first wing 26*b* and are advantageously symmetrical with respect to a horizontal central plane and are blended, by means of a lateral milling 51, with the free peripheral edge 52 of the wing 26*b*.

The dimensions of the lateral milling 51 are such as to allow the insertion and sliding of the head 23*b* of the second adjustment screw 14*b*, so as to arrange the annular milling 25*b* at the thickness of the first wing 26*b*.

A lateral gap, designated by the reference numeral 29*b* and formed between the first wing 26*b* and the base 17*b* of the post 11*b*, allows access to the head 23*b* of the second adjustment screw 14*b* so as to allow partial screwing-unscrewing thereof for optimum positioning and centering of the enclosure 2.

A strip, designated by the reference numeral 30*b*, is advantageously magnetic and is substantially rectangular, and allows the connection between the first profiled element 12*b* and the post 11*b*, thus closing the lateral gap 29*b*.

Below the enclosure 2, and spaced from the lower peripheral rim 53 thereof, the shower tray 3 is rested on the ground and has, at least at an arc-like side designated by the reference numeral 31, a peripheral rim 32 which is raised with respect to an internal useful surface designated by the reference numeral 33.

The raised peripheral rim 32 has, in a transverse cross-section, a configuration which curves upward and increases in height advantageously in the part that lies under the door 9.

An internal channel 34 for collecting water is adjacent to the peripheral rim 32 and surrounds the internal useful surface 33.

The collection channel 34, arranged downward with respect to the lower peripheral rim 53 of the enclosure 2, is inclined on the plane in order to convey the water to a drain, designated by the reference numeral 35, which is advantageously arranged along the channel 34 proximate to the door 9.

Use is thus as follows: with reference to FIG. 1, the first assembly operation consists in positioning and coupling, by way of conventional methods, the shower tray 3 to the floor of the cubicle 4 that accommodates the apparatus 1, which is conveniently arranged so as to rest laterally against the respective walls 5*a* and 5*b*.

Then the two posts are fixed, by means of the first connecting screws, to the respective walls 5*a* and 5*b*, so that the posts are conveniently arranged within the arc-like side 31 of the shower tray 3.

Then the enclosure 2 is assembled on the ground, associating the frame 6 with the glazing panels 7*a* and 7*b* and with the door 9.

Since the enclosure 2 is fully symmetrical, it can be turned upside down so as to determine at will the direction in which the door 9 opens.

The enclosure 2 is thus installed so as to be suspended on both posts by arranging the vertical slots in the respective annular millings formed in the heads of the adjustment screws.

It is thus possible to adjust the position and centering of the enclosure 2 with respect to the walls 5*a* and 5*b* by partially screwing or unscrewing the adjustment screws.

This intervention is allowed after installation because access to the adjustment screws occurs by means of the two lateral gaps that are present between the first profiled elements and the respective posts.

The gaps can be closed, once centering has been performed, by means of the appropriately provided strips, so as to protect the inside of the lateral gaps from water or any dirt and at the same time ensure an effective aesthetic impact.

During use, water flows by gravity from the internal surfaces of the enclosure 2 toward the lower peripheral rim 53 thereof, drips from there inside the shower tray 3, and is conveyed, by means of a system of slopes, first into the channel 34 and then into the drain 35.

It has thus been observed that the invention has achieved the intended aim and objects, a shower apparatus having been provided which is simple to install and easy and straightforward to clean, since there is no contact between the shower enclosure, which is suspended from two lateral posts, and the underlying shower tray.

The invention is of course susceptible of numerous modifications and variations, all of which are within the scope of the same inventive concept.

The materials used, as well as the dimensions that constitute the individual components of the invention, may of course be more pertinent according to specific requirements.

The disclosures in Italian Patent Application No. TV99A000127 from which this application claims priority are incorporated herein by reference.

What is claimed is:

1. A shower apparatus, comprising an enclosure and a shower tray, wherein said enclosure and said shower tray are mutually disconnected, said enclosure having means for adjustable connection to the walls that form a cubicle for accommodating said apparatus, and wherein said adjustable connection means are constituted by two vertical posts, each of which rests in a rear region against one of said walls; by a first profiled element, which is L-shaped and is rigidly coupled to said frame; by first connection screws for the detachable connection of said posts to said walls; and by second adjustment screws for the adjustable connection of the mutual position of said frame and said posts.

2. The apparatus according to claim 1, wherein said enclosure, which has, in plan view, a side being shaped like a circular arc with the convexity facing outward, is constituted by a frame having a peripheral seat inside which it is possible to arrange laterally two glazing panels which are rectangular and flat and are arranged adjacent to said walls.

3. The apparatus according to claim 2, wherein between said glazing panels there is an opening which is adapted to accommodate a door which is shaped like a circular arc and is coupled to said frame by means of two vertical hinges which protrude from said frame along the same axis.

4. The apparatus according to claim 1, wherein said adjustable connection means are constituted by two vertical posts, each of which rests in a rear region against one of said walls; by a first profiled element, which is L-shaped and is rigidly coupled to said frame; by first connection screws for the detachable connection of said posts to said walls; and by second adjustment screws for the adjustable connection of the mutual position of said frame and said posts.

5. The apparatus according to claim 1, wherein each one of said posts is constituted by a second profiled element, which has a C-shaped cross-section which forms a base and two wings, which have the same dimensions and protrude in the same direction toward said wall.

6. The apparatus according to claim 5, wherein said base of said second profiled element is arranged parallel to said wall and has first holes for detachable connection, by means of said first connection screws, to said wall, in which wall anchors are associated beforehand.

7. The apparatus according to claim 4, wherein locking elements are associated with each one of said posts and are constituted by nuts which are accommodated within said wings and are provided with second threaded holes whose axis is arranged horizontally, said locking elements being arranged at similar third holes formed in said base of said second profiled element in a staggered position with respect to said first holes.

8. The apparatus according to claim 7, wherein said second adjustment screw has a threaded stem which can be inserted, through said third and second holes, in said locking element or nut, and a head on the lateral surface whereof there is an annual milling.

9. The apparatus according to claim 5, wherein said first profiled element, which has an L-shaped cross-section, is arranged so as to have a first wing which is arranged approximately parallel to said base of said second profiled element and a second wing which is arranged at right angles to said first wings.

10. The apparatus according to claim 9, wherein at least one of said first and second wings has surfaces for coupling to said frame.

11. The apparatus according to claim 9, wherein two or more vertical slots are formed in said first wing, are symmetrical with respect to a central horizontal plane, and are blended, by means of a lateral milling, with a free peripheral edge of said first wing.

12. The apparatus according to claim 9, wherein the dimensions of said lateral milling are such as to allow the insertion and sliding of said head of said second adjustment screw so as to arrange said annular milling at the thickness of said first wing.

13. The apparatus according to claim 5, further comprising, between each one of said first wings and each one of said bases of said posts, a lateral gap for accessing said head of said second adjustment screw, so as to allow the partial screwing-unscrewing thereof for optimum positioning and centering of said enclosure.

14. The apparatus according to claim 13, comprising a strip, which is magnetic and substantially rectangular, for the connection of each one of said first profiles to each one of said posts, so as to allow to close said lateral gap.

15. The apparatus according to claim 1, wherein said shower tray, rested on the ground below said enclosure and spaced from a lower peripheral rim thereof, has a peripheral rim which is raised with respect to an internal usable surface.

16. The apparatus according to claim 15, wherein said raised peripheral rim is curved upward in transverse cross-section, said curvature increasing in height in the part below said door.

17. The apparatus according to claim 16, wherein said raised peripheral rim of said shower tray is arranged externally with respect to said lower peripheral rim of said enclosure and has a height from the ground which is greater than a distance from the ground of said lower peripheral rim of said enclosure.

18. The apparatus according to claim 15, comprising, inside said peripheral rim of said shower tray, a water collection channel which is arranged below said lower peripheral rim of said enclosure and surrounds said usable surface.

19. The apparatus according to claim 18, wherein said water collection channel has, with respect to the horizontal plane, an inclined arrangement in order to convey the water to a drain which is arranged along said channel proximate to said door.

20. A shower apparatus, comprising an enclosure and a shower tray, wherein said enclosure and said shower tray are mutually disconnected, a free space being defined between a lower edge of said enclosure and an upper edge of said shower tray, said enclosure being arranged within a perimeter of said shower tray, suspended from said shower tray, said enclosure having means for adjustable connection to the walls that form a cubicle for accommodating said apparatus, further comprising, substantially below said lower edge of the enclosure, adjacent to the upper edge of the shower tray and defined in said shower tray, a collection channel that extends along the perimeter of said shower tray.

21. The apparatus according to claim 20, wherein said enclosure, which has, in plan view, a side being shaped like a circular arc with the convexity facing outward, is constituted by a frame having a peripheral seat inside which it is possible to arrange laterally two glazing panels which are rectangular and flat and are arranged adjacent to said walls.

22. The apparatus according to claim 21, wherein between said glazing panels there is an opening which is adapted to accommodate a door which is shaped like a circular arc and is coupled to said frame by means of two vertical hinges which protrude from said frame along the same axis.

23. The apparatus according to claim 20, wherein said adjustable connection means are constituted by two vertical posts, each of which rests in a region against one of said walls; by a first profiled element, which is L-shaped and is rigidly coupled to said frame; by first connection screws for the detachable connection of said posts to said walls; and by second adjustment screws for the adjustable connection of the mutual position of said frame and said posts.

24. The apparatus according to claim 23, wherein each one of said posts is constituted by a second profiled element, which has a C-shaped cross-section which forms a base and two wings, which have the same dimensions and protrude in the same direction toward said wall.

25. The apparatus according to claim 24, wherein said base of said second profiled element is arranged parallel to said wall and has first holes for detachable connection, by means of said first connection screws, to said wall, in which wall anchors are associated beforehand.

26. The apparatus according to claim 23, wherein locking elements are associated with each one of said posts and are constituted by nuts which are accommodated within said wings and are provided with second threaded holes whose axis is arranged horizontally, said locking elements being arranged at similar third holes formed in said base of said second profiled element in a staggered position with respect to said first holes.

27. The apparatus according to claim 26, wherein said second adjustment screw has a threaded stem which can be inserted, through said third and second holes, in said locking element or nut, and a head on the lateral surface whereof there is an annual milling.

28. The apparatus according to claim 24, wherein said first profiled element, which has an L-shaped cross-section, is arranged so as to have a first wing which is arranged approximately parallel to said base of said second profiled element and a second wing which is arranged at right angles to said first wings.

29. The apparatus according to claim 28, wherein at least one of said first and second wings has surfaces for coupling to said frame.

30. The apparatus according to claim 28, wherein two or more vertical slots are formed in said first wing, are symmetrical with respect to a central horizontal plane, and are blended, by means of a lateral milling, with a free peripheral edge of said first wing.

31. The apparatus according to claim 28, wherein the dimensions of said lateral milling are such as to allow the insertion and sliding of said head of said second adjustment screw so as to arrange said annular milling at the thickness of said first wing.

32. The apparatus according to claim 24, further comprising, between each one of said first wings and each one of said bases of said posts, a lateral gap for accessing said head of said second adjustment screw, so as to allow the partial screwing-unscrewing thereof for optimum positioning and centering of said enclosure.

33. The apparatus according to claim 32, comprising a strip, which is magnetic and substantially rectangular, for the connection of each one of said first profiles to each one of said posts, so as to allow to close said lateral gap.

34. The apparatus according to claim 20, wherein said shower tray, rested on the ground below said enclosure and spaced from a lower peripheral rim thereof, has a peripheral rim which is raised with to an internal usable surface.

35. The apparatus according to claims 34, wherein said raise peripheral rim is curved upward in transverse cross-section, said curvature increasing in height in the part below said enclosure or door.

36. The apparatus according to claim 35, wherein said raised peripheral rim of said shower tray is arranged externally with respect to said lower peripheral rim of said enclosure and has a height from the ground which is greater than a distance from the ground of said lower peripheral rim of said enclosure, comprising, inside said peripheral rim of said shower tray, a collection channel which is arranged below said lower peripheral rim of sid enclosure and surrounds said usable surface.

37. The apparatus according to claim 20, wherein said water collection channel has, with respect to the horizontal plane, an inclined arrangement in order to convey the water to a drain which is arranged along said channel proximate to said door.

* * * * *